United States Patent [19]

Santillo et al.

[11] Patent Number: 4,783,184

[45] Date of Patent: Nov. 8, 1988

[54] ENDLESS RIBBON CASSETTE WITH EXIT PORT RIBBON CONTROL

[75] Inventors: Joseph C. Santillo, Dublin; James M. Seybold, Dayton, both of Ohio

[73] Assignee: NCR Corporation, Dayton, Ohio

[21] Appl. No.: 79,986

[22] Filed: Jul. 31, 1987

[51] Int. Cl.[4] ..... B41J 32/102

[52] U.S. Cl. ..... 400/196.1; 400/208

[58] Field of Search ..... 400/194, 195, 196, 196.1, 400/207, 208, 208.1, 235.1, 248

[56] References Cited

U.S. PATENT DOCUMENTS

| | | | |
|---|---|---|---|
| 3,989,132 | 11/1976 | Carson, Jr. | 400/195 |
| 4,209,261 | 6/1980 | Bell et al. | 400/196.1 |
| 4,212,550 | 7/1980 | Helinski | 400/235.1 X |
| 4,229,112 | 10/1980 | Schaefer | 400/196.1 |
| 4,270,867 | 6/1981 | Haftmann | 400/196.1 X |
| 4,286,887 | 9/1981 | Hisakawa et al. | 400/196.1 |
| 4,293,234 | 10/1981 | Yonkers et al. | 400/195 X |
| 4,536,098 | 8/1985 | Sheehan et al. | 400/196.1 |
| 4,616,942 | 10/1986 | Nagasawa et al. | 400/196.1 |
| 4,645,364 | 2/1987 | Ohsaki | 400/196.1 X |

FOREIGN PATENT DOCUMENTS

| | | | |
|---|---|---|---|
| 2368365 | 5/1978 | France | 400/196.1 |

OTHER PUBLICATIONS

IBM Technical Disclosure Bulletin, "Printer Ribbon Cassette", Brumbaugh et al, vol. 19, No. 8, Jan. 1977, pp. 2978–2979.

IBM Technical Disclosure Bulletin, "Ribbon Cartridge Exit Impedance", Dowd, vol. 20, No. 11B, Apr. 1978, pp. 4739–4740.

*Primary Examiner*—Ernest T. Wright, Jr.

*Attorney, Agent, or Firm*—Wilbert Hawk, Jr.; Albert L. Sessler, Jr.; George J. Muckenthaler

[57] ABSTRACT

A ribbon cassette for an endless ribbon comprises a first portion and a second portion of substantially identical structure and each portion includes a dam adjacent the exit port of the cassette. A ramp is formed adjacent each dam for centering the ribbon as it travels from the ribbon chamber between the ramps and the dams for providing improved tracking and control of the ribbon through the exit port.

7 Claims, 2 Drawing Sheets

ENDLESS RIBBON CASSETTE WITH EXIT PORT RIBBON CONTROL

BACKGROUND OF THE INVENTION

In the field of inked ribbons, a supply spool and a take-up spool have been provided on opposite sides of a typing or printing station with means for reversing the direction of travel of the ribbon to obtain longer ribbon life. The inked ribbon has usually been made to travel along a line of printing wherein the spools are positioned beyond the ends of the printing line. However in the case of certain printers, a wide ribbon is used and is made to travel in a direction that is normal to the print line.

In the present day printers, it is common practice to use a ribbon cassette carrying an endless ribbon which is caused to be driven past the printing station with the ribbon being either a pre-inked ribbon or a ribbon which is to be continuously or frequently reinked during the printing operation. The ribbon cassette may be of the stuffing box type, wherein the ribbon is contained within the cassette in random manner and the ribbon is unfolded at the cassette exit and is caused to be driven past the printing station and then trained to enter the cassette to be folded in random manner therein. A ribbon may be utilized in a mobius loop configuration wherein the ribbon is in substantially continuous contact with an inking core or the ribbon may have a plurality of coils around a core for controlled inking thereof.

It is seen that the inked ribbon requires proper positioning and control in its path from the stuffed condition in the cavity of the cassette and through the exit port towards the printing station. The inked ribbon needs to pass freely through the exit port from the cavity and also be restrained in a manner to provide proper tautness of the ribbon past the printing station.

Representative prior art in ribbon cassettes is disclosed in U.S. Pat. No. 4,209,261, issued to D. W. Bell et al. on June 24, 1980, which shows a ribbon cassette having a dam over which the ribbon travels when exiting from the stuffing cavity.

U.S. Pat. No. 4,536,098, issued to B. P. Sheehan et al. on Aug. 20, 1985, discloses a ribbon cassette having a body portion with a dam in the cavity thereof and a cover with a dam opposite the cavity dam and wherein the ribbon passes between the dams.

U.S. Pat. No. 4,616,942, issued to H. Nagasawa et al. on Oct. 14, 1986, discloses a ribbon cassette having a dam portion over which the ribbon crosses when leaving the stuffing chamber.

SUMMARY OF THE INVENTION

The present invention relates, generally, to ribbon cassettes for use in impact printers. More particularly, the present invention relates to a ribbon cassette which includes a cavity or chamber that carries the inked ribbon in stuffing box manner and has entrance and exit ports for travel of the ribbon in a path past a printing station. The exit port provides a pair of ribs or dams allowing for passage and support of the ribbon but providing restraint and holding back thereof so as to properly guide and control the inked ribbon in its path from the cassette cavity.

The ribbon cassette comprises two identical body half portions each having a dam integral with a respective portion and positioned just inside the exit port for effectively centering and restraining the inked ribbon. A ramp is provided an an integral part of each half of the ribbon cassette and is located within the cavity of the cassette just prior to the exit port and adjacent each of the dams on the inward side thereof. The ramps help to properly position the inked ribbon for centering thereof through the exit port and also position the ribbon so that each dam equally restricts the ribbon as it passes therebetween.

In view of the above discussion, a principal object of the present invention is to provide means for positioning an inked ribbon in the passing thereof from the cavity and through an exit of a ribbon cassette.

Another object of the present invention is to provide a ribbon cassette having guide and control means for supporting the inked fabric in proper position when traveling through an exit of the cassette.

An additional object of the present invention is to provide a ribbon cassette having substantially identical body portions and including integral dam portions for effectively centering the ribbon through the exit port of the cassette.

A further object of the present invention is to provide a ramp in the cavity of a ribbon cassette for positioning the inked fabric so as to enable each dam portion to equally restrict the ribbon in its travel through the exit port of the cassette.

Additional advantages and features of the present invention will become apparent and fully understood from a reading of the following description taken together with the annexed drawing.

DESCRIPTION OF THE PREFERRED EMBODIMENT

The present invention includes a ribbon cassette for use in a printer wherein an endless ribbon is stored in stuffing-box manner in the body of the cassette and is caused to be exited from the body through an exit port located at one end of the cassette.

Figures 1, 2:
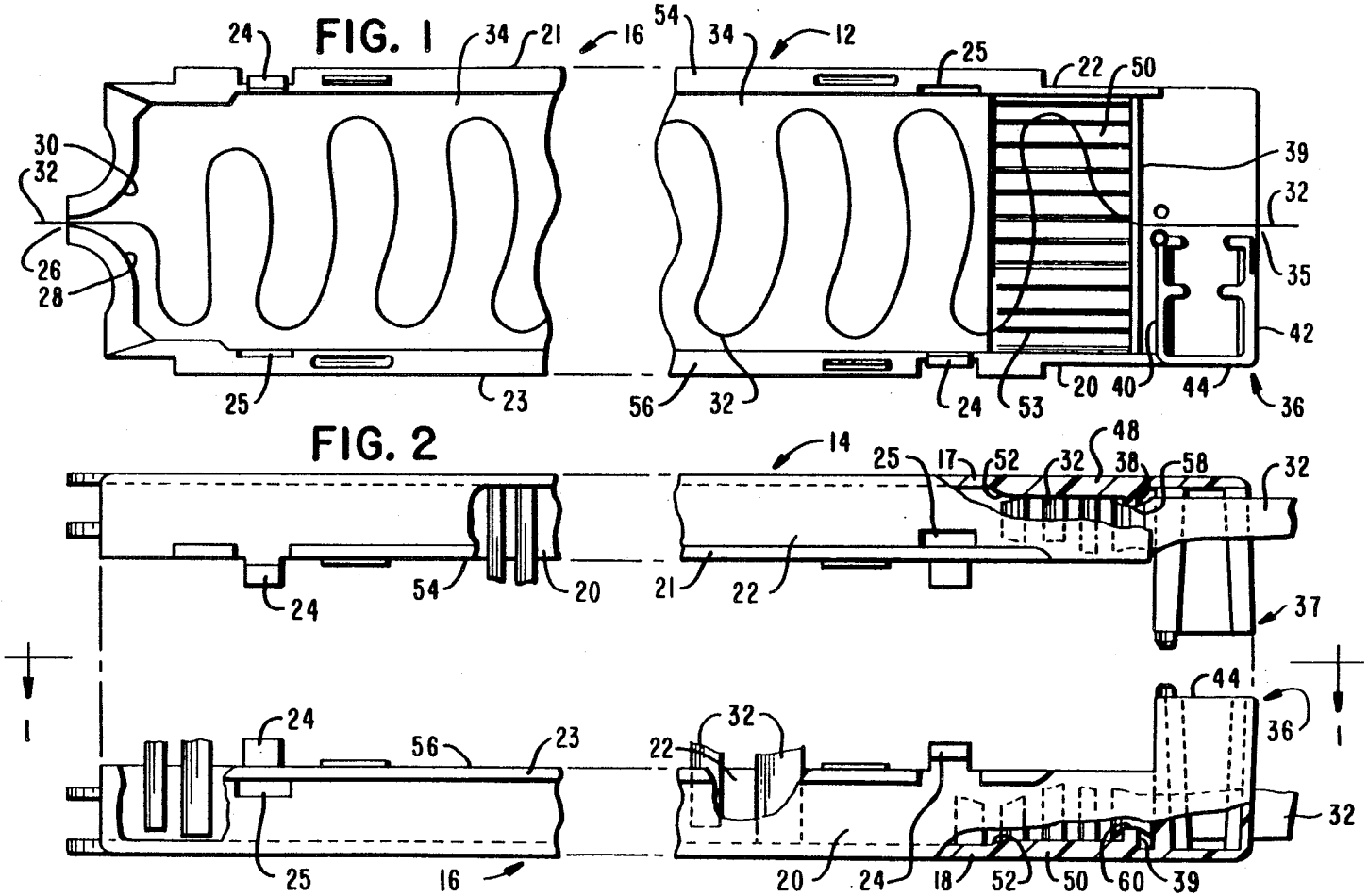
FIG. 1 is a sectional view of a ribbon cassette, taken along section line 1—1 of FIG. 2, and showing the location of the ramp structure of the present invention.
FIG. 2 is a side elevational view of the ribbon cassette showing the ramp structure in each half portion of the cassette.
Figure 4:
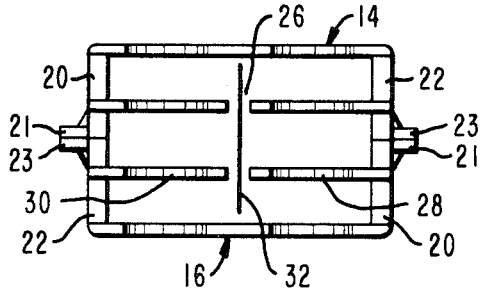
FIG. 4 is a left hand side elevational view of the cassette.

Referring now to FIGS. 1 and 2, a ribbon cassette, generally indicated at 12, includes a top portion 14 and a bottom portion 16, such portions 14 and 16 being identical in structure and forming the two halves of the cassette 12. FIG. 1 illustrates the bottom portion 16 of the cassette 12, as viewed in the direction of the arrows 1—1 of FIG. 2. The ribbon cassette 12 is a long and narrow design and the top portion 14 includes a top plate 17, and the bottom portion 16 includes a bottom plate 18 (FIG. 2) and two side plates 20 and 22 (FIGS. 1 and 4) with latch members, as at 24, for securing the top and bottom portions 14 and 16 to each other along abutting flanges 21 and 23, and latching with mating ledges or lips 25. The top portion 14 also includes two side plates 20 and 22 with flanges 21 and 23, latch members 24 and mating ledges or lips 25. The left side of the cassette 12 has an inlet or entrance port 26 (FIGS. 1 and 4) defined and framed by curved portions 28 and 30 which guide and control an endless ribbon 32 in vertical orientation as it enters the body or cavity 34 (FIG. 1) of the cassette 12.

Figure 3:
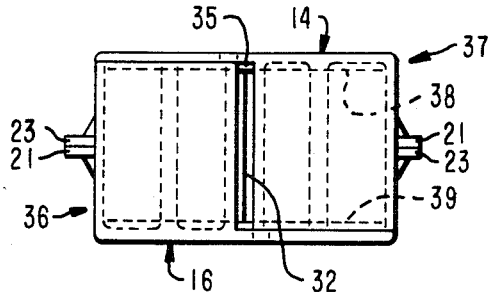
FIG. 3 is a right hand side elevational view of the cassette.

The right hand side of the cassette 12 provides an outlet or exit port 35 for the ribbon 32 (FIGS. 1 and 3) and includes upstanding portions, generally indicated at 36 and 37 (FIGS. 2 and 3). The upstanding portions 36 and 37 are integral parts of the respective top and bottom portions 14 and 16, and are located outside the cavity 34. A dam 38 stretches across the top portion 14 of the cassette 12 and a dam 39 (FIG. 1) stretches across the bottom portion 16 of the cassette 12 at the end of the cavity 34. The upstanding portions 36 and 37 occupy slightly less than one-half of the distance across the end of the cassette 12 (FIG. 1), so that an opening is provided between the two upstanding portions 36 and 37 in assembled relationship to provide the exit port 35 for the ribbon 32 (FIG. 3). The upstanding portions 36 and 37 each include a left portion 40 (FIG. 1) adjacent the respective dams 38 and 39, a right portion 42 at the end of the cassette 12, and a connection or side portion 44. The portions 40, 42 and 44 essentially serve as walls providing support structure for the portions 14 and 16.

A ramp structure 48, formed integral with the top plate 17 and a ramp structure 50, formed integral with the bottom plate 18 of the cassette 12 (FIG. 2), extend across the end of the cavity 34 (FIG. 1) and each ramp structure 48, 50 includes a curved portion 52 (FIG. 2) which is contacted by the edge of the ribbon 32 as it exits from the cavity 34. The height of each of the ramp structures 48 and 50 is about one-half the height of the respective dams 38 and 39.

FIG. 2 shows one of the side portions of each of the two identical halves of the cassette 12 and the manner of construction thereof wherein the ribbon 32 is guided and contained by the ramp structure 48 of the cassette top portion 14 and by the ramp structure 50 of the bottom portion 16. Of course, it is noted that the two portions 14 and 16 are shown widely separated and that in the assembly of the portions 14 and 16, the surfaces 54 and 56 are in contact with each other and further that the upstanding portions 36 and 37 fit together, as shown in FIG. 3.

The ramp structure 48 and 50 adjacent the dams 38 and 39 of the portions 14 and 16 provide means for vertically centering the ribbon 32 (FIG. 2) so that each of the dams 38 and 39 restricts or restrains the ribbon 32 an equal amount during exit of the ribbon 32 from the cavity 34 of the cassette 12. The ramp structures 48 and 50 of the cassette portions 14 and 16 effectively train or guide the inked ribbon 32 in a path from the cavity 34 and through the exit port 35. The ramp structures 48 and 50 position the ribbon 32 in a vertical orientation at a height to provide equal restraint of the ribbon 32 by the dams 38 and 39 as the ribbon 32 passes therebetween. While each of the ramp structures 48 and 50 is designed and molded as having a ribbed surface with ribs 53 (FIG. 1), the surface may be plain or smooth.

The ribbon 32 is nominally one inch wide and is stored in the cavity 34 in stuffing manner (FIG. 1). The height of the cavity 34 is slightly greater than the width of the ribbon 32 to allow for freedom of travel within the cavity 34 so that there is a small amount of clearance between the top edge of the ribbon 32 and the ceiling of the cavity 34. FIG. 2 shows the ribbon 32 in edgewise manner in diagrammatic form and illustrates the clearance between the top and bottom portions 14 and 16 of the cassette 12 and the edge of the ribbon 32. When the ribbon 32 passes between the ramp structure 48 and 50 of the cassette portions 14 and 16, the ribbon edges are in contact with the surfaces of the ramp structures 48 and 50 so that the ribbon 32 is guided and controlled in a vertically centered position prior to exit from the cavity 34. The ribbon 32 is momentarily squeezed or restrained an equal amount by the dams 38 and 39 of portions 14 and 16 for the purpose of placing a slight restriction or retarding force on the travel of the ribbon 32, the squeezed effect being shown at 58 and 60 (FIG. 2). The height of the dams 38 and 39, the height of the stuffing cavity 34, and the width of the ribbon 32 along with the height of the ramp structures 48 and 50 all figure in the design and construction of the ribbon cassette 12 for effectively restraining the inked fabric ribbon 32 as it leaves the cavity 34 and for guiding the ribbon 32 around suitable printer guides (not shown) adjacent the cassette 12 for proper tracking of the ribbon 32.

It is thus seen that herein shown and described is a ribbon cassette 12 of the stuffing-box type that includes means for vertically centering the ribbon 32 and for helping to prevent jamming of the ribbon 32 at the exit end or port 35 of the cassette 12. The present invention enables the accomplishment of the objects and advantages mentioned above, and while a preferred embodiment of the invention has been disclosed herein, variations thereof may occur to those skilled in the art. It is contemplated that all such variations and modifications not departing from the spirit and scope of the invention hereof are to be construed in accordance with the following claims.

We claim:

1. A ribbon cassette containing a ribbon and comprising a first portion and a second portion, said first portion and said second portion comprising identical half portions of the ribbon cassette and including side walls defining a cavity for storing said ribbon, an entrance port and an exit port adjacent said ribbon storing cavity for travel of said ribbon into and out of said ribbon cassette, restraining means comprising identical opposed dams positioned to connect the side walls on each of said first and second portions adjacent the exit port for restraining the ribbon between the first portion and the second portion when the ribbon is traveling through said exit port, and means comprising identical opposed ramp structures integral with and positioned on each of said first and second portions adjacent the opposed dams and extending across the end of the ribbon storing cavity for centering the ribbon with respect to said opposed dams prior to exit of the ribbon from said cavity.

2. The ribbon cassette of claim 1 wherein the ramp structures comprise generally rectangular raised portions extending across one end of the ribbon storing cavity.

3. The ribbon cassette of claim 1 wherein each of the ramp structures includes a curved portion at one edge thereof for shifting the ribbon prior to travel of the ribbon through the exit port of the ribbon cassette.

4. A cassette for an endless ribbon comprising an upper portion and a lower portion, said upper portion and said lower portion comprising identical half portions of the cassette and including side walls defining the body of the cassette and forming a chamber for storing the endless ribbon in random manner, an exit port positioned at one end of the chamber for passage of the endless ribbon therefrom, restraining means comprising identical opposed dams integral with and positioned to connect the side walls on each of said upper and lower portions adjacent the exit port for restraining the endless ribbon when passing therethrough, and means comprising identical opposed ramp structures integral with and positioned on each of said upper and lower portions adjacent the opposed dams and extending across the end of the chamber for maintaining the endless ribbon in a vertically centered position relative to the upper and lower portions when the endless ribbon is traveling through the exit port of the cassette.

5. The cassette of claim 4 wherein each of the ramp structures includes an edge portion having a radius for raising the endless ribbon prior to travel of the endless ribbon through the exit port of the cassette.

6. The cassette of claim 4 wherein each of said ramp structures is provided across one end of the endless ribbon storing chamber at a height less than the height of the respective dam adjacent thereto.

7. In a ribbon cassette having a first portion and a second portion, each portion constituting identical structures and including side walls formed to provide a chamber for randomly storing a ribbon therein, an entrance port and an exit port arranged at the ends of the ribbon cassette for travel of the ribbon into and out of the chamber, and means comprising identical opposed dams connecting the side walls and adjacent the exit port for restraining the ribbon when passing therethrough, the improvement comprising means comprising identical opposed ramp structures integral with the first portion and the second portion and provided within and extending across one end of the chamber and connecting the side walls and adjacent the exit port of the ribbon cassette for centering the ribbon between the first portion and the second portion as the ribbon travels through the exit port of the ribbon cassette.

* * * * *